US006919502B1

(12) United States Patent
Yamamoto

(10) Patent No.: US 6,919,502 B1
(45) Date of Patent: Jul. 19, 2005

(54) MUSICAL TONE GENERATION APPARATUS INSTALLING EXTENSION BOARD FOR EXPANSION OF TONE COLORS AND EFFECTS

(75) Inventor: Takao Yamamoto, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/585,243

(22) Filed: May 31, 2000

(30) Foreign Application Priority Data

Jun. 2, 1999 (JP) ..... 11-154785

(51) Int. Cl.[7] ..... G10H 1/06

(52) U.S. Cl. ..... 84/622; 84/625; 84/659; 84/660

(58) Field of Search ..... 84/622–633, 659, 84/660, 601–607, 615–620, 639–643, DIG. 29, 609–614, 634–638, 716

(56) References Cited

U.S. PATENT DOCUMENTS

| | | | | | |
|---|---|---|---|---|---|
| 4,147,083 | A | * | 4/1979 | Woron et al. | 84/622 |
| 4,250,788 | A | * | 2/1981 | Franz et al. | 84/602 X |
| 4,922,794 | A | * | 5/1990 | Shibukawa | 84/601 |
| RE33,607 | E | * | 6/1991 | Yuzawa et al. | 84/DIG. 29 |
| 5,278,348 | A | * | 1/1994 | Eitaki et al. | 84/636 |
| 5,714,705 | A | | 2/1998 | Kishimoto et al. | |
| 6,069,311 | A | * | 5/2000 | Hiramatsu | 84/659 |
| RE37,367 | E | * | 9/2001 | Wachi et al. | 84/603 |

FOREIGN PATENT DOCUMENTS

| | | |
|---|---|---|
| JP | 06-102865 | 4/1994 |
| JP | 06-222760 | 8/1994 |
| JP | 07-121173 | 5/1995 |
| JP | 07-168563 | 7/1995 |
| JP | 09-090953 | 4/1997 |
| JP | 10-319952 | 12/1998 |
| JP | 10-319953 | 12/1998 |
| JP | 10-319954 | 12/1998 |
| JP | 2000-081883 | 3/2000 |
| JP | 2000-089760 | 3/2000 |

* cited by examiner

*Primary Examiner*—Marlon T. Fletcher
*Assistant Examiner*—David S. Warren
(74) *Attorney, Agent, or Firm*—Morrison & Foerster LLP

(57) ABSTRACT

A musical tone generation apparatus is basically configured by a main sound source device installing an extension board. Herein, the main sound source device is configured by a CPU, memories, operators, a music synthesizer, a mixer, an effector and a sound system, while the extension board is configured by fabricating a CPU (or sequencer), memories and a music synthesizer (or effector). When the extension board is installed in the main sound source device, function setting data regarding new functions installed on the extension board is automatically transferred to the main sound source device so that a user is capable of adequately setting and controlling the new functions by using the operators. If the extension board corresponds to a tone color extension board that provides extended tone colors which differ from preset tone colors being installed in the main sound source device in advance, the main sound source device is capable of generating musical tones using the extended tone colors. In that case, it is possible for the sequencer to enable reproduction of a specific sound pattern such as an arpeggio and a phrase to be suited to the extended tone color(s). If the extension board corresponds to an extended effect board that provides extended effects such as harmony, reverb, chorus and echo, the main sound source device is capable of adequately imparting them to musical tones or other sounds.

28 Claims, 8 Drawing Sheets

MUSICAL TONE GENERATION APPARATUS INSTALLING EXTENSION BOARD FOR EXPANSION OF TONE COLORS AND EFFECTS

BACKGROUND OF THE INVENTION

1. Field of the Invention

This invention relates to musical tone generation apparatuses that generate musical tones in response to desired tone colors. This invention also relates to extension boards which are installed in the musical tone generation apparatuses for expansion of tones colors and effects.

This application is based on Patent Application No. Hei 11-154785 filed in Japan, the content of which is incorporated herein by reference.

2. Description of the Related Art

In general, extension boards fabricating extended memories and devices are widely used and interconnected with main units of computer systems to enhance their functions or add new functions.

Similar to the computer systems, musical tone generation apparatuses such as sound source devices (or tone generators) and electronic musical instruments install tone color extension boards to enable generation of musical tones using extended tone colors, which differ from preset tone colors originally stored therein. Or, they install extended effect boards to add new effect functions.

Conventionally, the extension boards such as the tone color extension boards are designed to merely store new tone colors, which are selected for generation of musical tones in response to key-operation signals given from an external system or device.

Generally, the sound source devices do not install sequencer functions. Therefore, in order to generate a specific sound pattern such as an arpeggio (i.e., succession of notes) and a phrase (i.e., unit of melody sounds) in response to a new tone color being provided by the tone color extension board, it is necessary to provide a special device which is exclusively used for generation of sound patterns. For example, a sequencer is interconnected with the sound source device to enable generation of sound patterns. That is, the sequencer generates a key-depression signal designating generation of the sound pattern, which is input to the tone color extension board. Thus, the sound pattern is generated using the extended tone color of the tone color extension board.

As described above, the conventional musical tone generation apparatus installing the extension board suffers from problems due to incapability in direct execution of extended functions.

SUMMARY OF THE INVENTION

It is an object of the invention to provide a musical tone generation apparatus, which installs an extension board to directly enable its new extended functions with ease without intervention of other devices.

It is another object to provide a musical tone generation apparatus that is capable of directly controlling new functions of the extension board.

A musical tone generation apparatus of this invention is basically configured by a main sound source device installing an extension board. Herein, the main sound source device is configured by a CPU, memories, operators, a music synthesizer, a mixer, an effector and a sound system, while the extension board is configured by fabricating a CPU (or sequencer), memories and a music synthesizer (or effector). When the extension board is installed in the main sound source device, function setting data regarding new functions installed on the extension board is automatically transferred to the main sound source device so that a user is capable of adequately setting and controlling the new functions by using the operators. If the extension board corresponds to a tone color extension board that provides extended tone colors which differ from preset tone colors installed in the main sound source device in advance, the main sound source device is capable of generating musical tones using the extended tone colors. In that case, it is possible for the sequencer to enable reproduction of a specific sound pattern such as an arpeggio and a phrase to be suited to the extended tone color(s). If the extension board corresponds to an extended effect board that provides extended effects such as harmony, reverb, chorus and echo, the main sound source device is capable of adequately imparting them to musical tones or other sounds.

Because the extended board has its own CPU and music synthesizer, execution of the new functions and/or extended tone colors do not increase loads of processing of the CPU of the main sound source device. So, it is possible to easily install new functions and/or extended tone colors in the main sound source device without causing any delay in generation of musical tones or other sounds. In addition, the new functions can be easily set and controlled by the operators of the main sound source device, so it is possible to improve performability in actualization of the new functions.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

Figure 1:
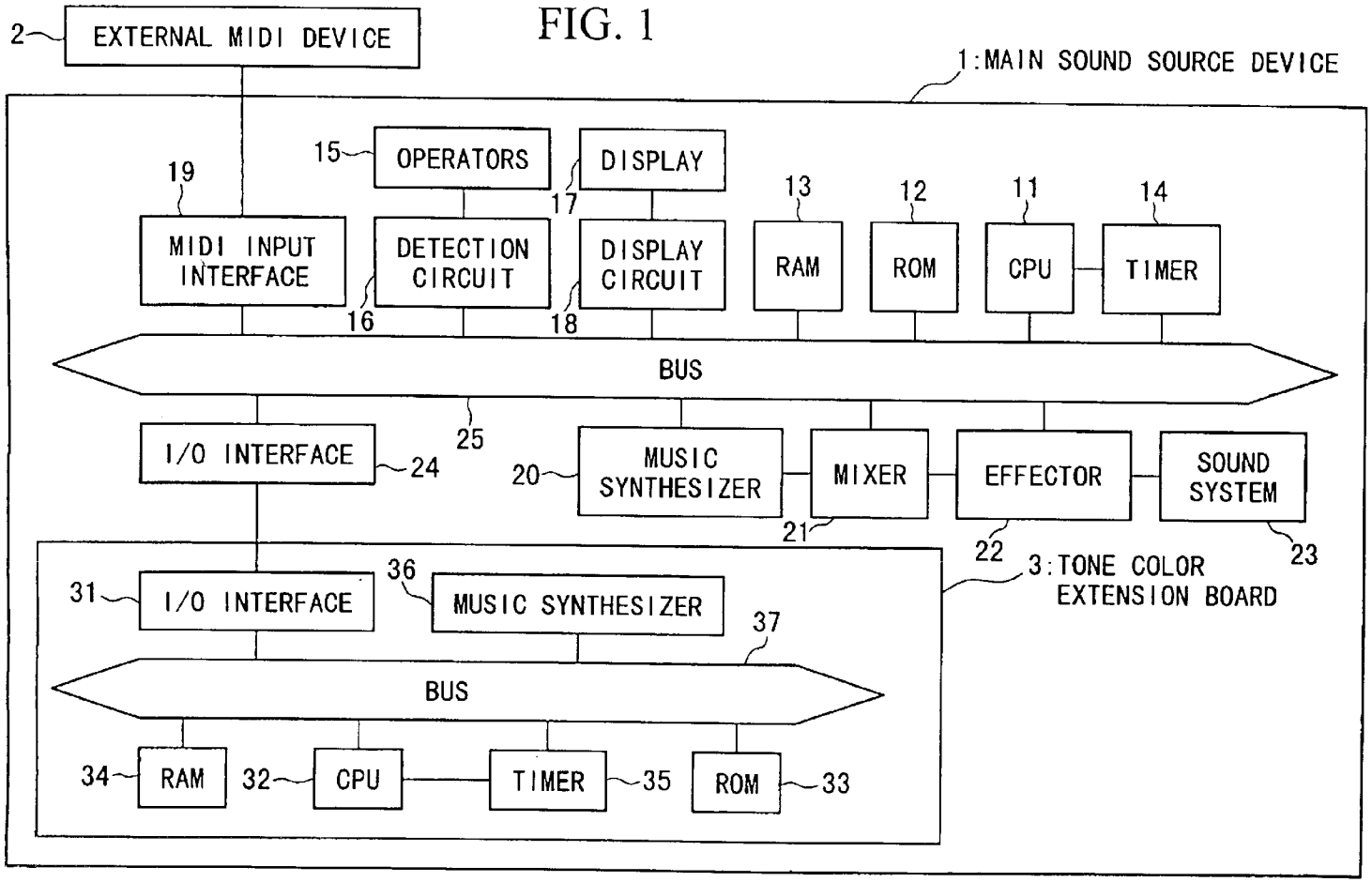
FIG. 1 is a block diagram showing a configuration of a musical tone generation apparatus installing a tone color extension board in accordance with an embodiment of the invention.

FIG. 1 is a block diagram showing an overall configuration of a musical tone generation apparatus installing an extension board in accordance with an embodiment of the invention. Herein, a main sound source device 1 is shown as an example of the musical tone generation apparatus, and a tone color extension board 3 is installed in the main sound source device 1 as the extension board.

In addition, the main sound source device 1 is connected with an external MIDI device 2 (herein, "MIDI" is an abbreviation for the known standard of "Musical Instrument Digital Interface"). The external MIDI device 2 represents a sequencer, an electronic musical instrument or a personal computer installing a MIDI keyboard or MIDI sequencer software. The main sound source device 1 generates musical tones in response to MIDI signals given from the external MIDI device 2. The tone color extension board 3 installs a music synthesizer (36) enabling generation of tone colors which are not stored in the main sound source device 1. Incidentally, the tone color extension board 3 installs extended tone colors as well as a special tool or measure (not shown, details will be described later) for actualization of new functions which utilize the extended tone colors and which are not stored in the main sound source device 1. As an example of the new functions, the present specification describe a sequencer function that actualizes generation of sound patterns such as arpeggio sounds and melody sounds of phrases.

The main sound source device 1 is originally designed to generate musical tones in response to preset tone colors and is configured by memories, circuits and components, as follows:

A CPU (i.e., central processing unit) 11 controls overall operation of the main sound source device 1. A ROM (i.e., read-only memory) 12 stores waveform data and setting data with regard to the preset tone colors. In addition, the ROM 12 also stores operation programs with regard to functions originally installed in the main sound source device 1. A RAM (i.e., random-access memory) 13 stores various kinds of data such as function setting data which allow the main sound source device 1 to control tone color information presently selected and new functions installed on the tone color extension board 3 being interconnected with the main sound source device 1. A timer 14 generates various kinds of timing signals, one of which is being generated in response to a tempo.

reference numeral "15" collectively designates manual operable members such as switches, keys and controls (hereinafter, simply referred to as "operators"). Herein, the operators 15 are used to set the tone colors for generation of musical tones as well as tone color parameters in the main sound source device 1. In addition, they are used to set tone color parameters and sound patterns for the tone color extension board 3. Basically, the operators 15 are actualized by "physical switches" or "software switches" that operate in cooperation with a display 17 in accordance with software. A detection circuit (or detection circuits) 16 detects operations of the operators 15.

The display 17 displays setting conditions and operation conditions on a screen thereof. A display circuit 18 drives the display 17. A MIDI interface circuit 19 inputs MIDI signals from the external MIDI device 2.

A music synthesizer 20 synthesizes and generates musical tone signals over multiple channels. The music synthesizer 20 is able to employ any type of music synthesis methods such as waveform memory method, frequency modulation (FM) method, physical model method, higher harmonic synthesis method, formant synthesis method and analog synthesizer method (e.g., VCO+VCF+VCA, where "VCO" is an abbreviation for "voltage-controlled oscillator" and "VCA" is an abbreviation for "voltage-controlled amplifier"). In addition, the music synthesizer 20 is not necessarily designed as a hardware music synthesizer that is configured using specially designed hardware. So, it is possible to employ a music synthesizer that is configured using a digital signal processor (i.e., DSP) and its microprogram or a music synthesizer that is configured using a CPU and its software program. In addition, the music synthesizer 20 can be designed to realize multiple tone-generation channels by using a single circuit in time-division manner, or it can be designed such that a single tone-generation channel is realized by a single circuit.

A mixer 21 is capable of mixing together three kinds of musical tones, namely, musical tones generated by the music synthesizer 20, musical tones generated by the tone color extension board 3 and effect-imparted musical tones output from an effector 22. The effector 22 imparts various kinds of effects such as vibrato and reverb to musical tone signals output from the mixer 21 and musical tone signals output from the music synthesizer 20. A sound system 23 amplifies and produces effect-imparted musical tones being output from the effector 22.

An I/O interface 24 provides interconnection between the main sound source device 1 and the tone color extension board 3. A bus 25 interconnects together the aforementioned blocks of the main sound source device 1.

FIG. 1 does not show all parts and elements of the musical tone generation apparatus. In other words, FIG. 1 excludes illustrations of some components of the musical tone generation apparatus such as an external waveform input terminal and an A/D converter, for example. Herein, the external waveform input terminal inputs waveform signals from a microphone or an audio device (not shown), while the A/D converter converts analog input signals of the external waveform input terminal to digital signals, which are forwarded to the mixer 21.

The tone color extension board 3 is configured by memories, circuits and components as follows:

An I/O interface 31 is interconnected with the aforementioned I/O interface 24 of the main sound source device 1. That is, the main sound source device 1 produces key-operation information, various kinds of setting information and tone color select information, which are transferred to the tone color extension board 3 by way of the I/O interface 31. On the other hand, the tone color extension board 3 produces function setting data and musical tone signals regarding the extended tone colors, which are transferred to the main sound source device 1 by way of the I/O interface 31.

A CPU 32 controls operations of the tone color extension board 3. A ROM 33 stores operation programs with regard to functions installed on the tone color extension board 3. In addition, the ROM 33 stores waveform data and tone color setting data with regard to the extended tone colors. Further, the ROM 33 stores function setting data which allow the main sound source device 1 to control the functions of the tone color extension board 3. A RAM 34 stores tone color information being presently selected and key-operation information (i.e., sound pattern generation information used for generation of sound patterns). In addition, the RAM 34 also stores setting information (i.e., tempo data, pattern-on/off information, parameters) with regard to generation of the sound patterns. A timer 35 generates various kinds of timing information.

A music synthesizer 36 synthesizes and generates musical tones with respect to the extended tone colors provided by the tone color extension board 3. Herein, the music synthesizer 36 is capable of generating musical tones over a single channel or multiple channels. As similar to the aforementioned music synthesizer 20 of the main sound source device 1, the music synthesizer 36 of the tone color extension board 3 is able to use various kinds of music synthesis methods. A bus 37 performs data transfer between the aforementioned blocks within the tone color extension board 3.

FIGS. 2A to 2D show examples of configurations of data being stored in the ROM 33 of the tone color extension board 3.

Figure 2A:
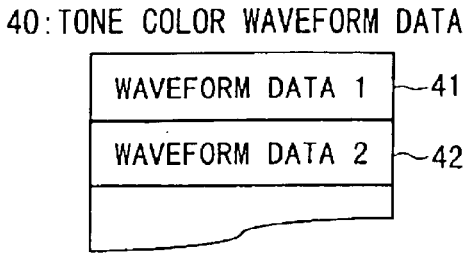
FIG. 2A shows a configuration of tone color waveform data.

Specifically, FIG. 2A shows tone color waveform data 40 for storing multiple waveform data 41, 42, . . . , which are used to generate musical tones with respect to the extended tone colors of the tone color extension board 3.

Figure 2B:
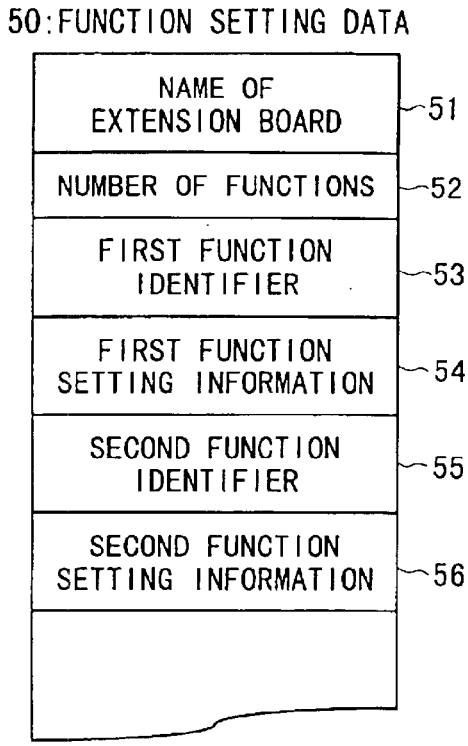
FIG. 2B shows a configuration of function setting data.

FIG. 2B shows function setting data 50, which are related to special functions of the tone color extension board 3. When the tone color extension board 3 is installed into the main sound source device 1, the function setting data 50 are automatically transferred to the main sound source device 1 by way of the I/O interfaces 31 and 24. In the main sound source device 1, the function setting data 50 are used to enable function assignment to switches corresponding to the aforementioned operators 1. Therefore, a performer is capable of selectively setting the functions of the tone color extension board 3 by using the switches of the main sound source device 1.

As shown in FIG. 2B, the function setting data 50 store an extension board name 51 for identifying the tone color extension board 3 and a function number 52 indicating a number of the special functions of the tone color extension board 3. The function setting data 50 also store setting information and identifiers with respect to various functions of the tone color extension board 3. That is, a first function identifier 53 indicates a name of a first function of the tone color extension board 3, and first function setting information 54 allow the main sound source device 1 to control the first function by using specific operators. Similarly, a second function identifier 55 indicates a name of a second function of the tone color extension board 3, and second function setting information 56 allow the main sound source device 1 to control the second function by using specific operators. The function setting data 50 further store other identifiers and setting information sequentially with respect to other functions of the tone color extension board 3.

For example, it is proposed that the first function of the tone color extension board 3 corresponds to an arpeggio pattern generation function that enables generation of a broken chord in response to key-depression information, which is created when a performer simultaneously depresses multiple keys each of which is lower than a prescribed pitch. In that case, the first function setting information 54 contains information used for assignment of four (first to fourth) functions to specific switches of the operators 15 of the main sound source device 1. That is, a first function allows a performer to make a decision whether to use the arpeggio pattern generation function. A second function allows the performer to select a desired type of the arpeggio pattern from among various types of arpeggio patterns. A third function is a tempo setting function that allows the performer to set a tempo for generation of the arpeggio pattern. A fourth function is an arpeggio register setting function that allows the performer to designate a register which is used for generation of the arpeggio pattern. In addition, it is proposed that the second function corresponds to a phrase pattern generation function that enables reproduction of a prescribed phrase which is assigned to a specific key (or tone pitch) being depressed by a performer. In that case, the second function setting information 56 contain function used for assignment of four (first to fourth) functions to switches of the operators 15 of the main sound source device 1. That is, a first function allows a performer to make a decision whether to use the phrase pattern generation function. A second function allows the performer to change assignment of the phrase pattern to each key (or tone pitch). A third function allows the performer to set a tempo for reproduction of the phrase pattern. A fourth function allows the performer to designate a register used for reproduction of the phrase pattern.

Figure 2C:
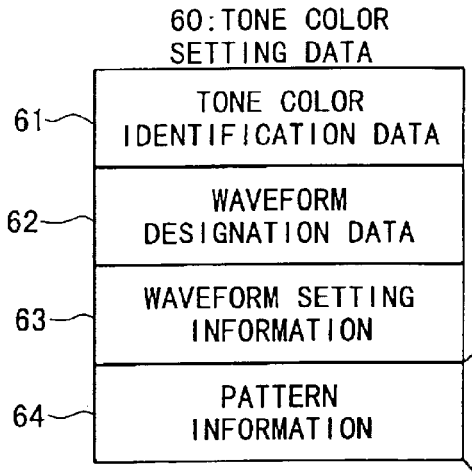
FIG. 2C shows a configuration of tone color setting data.

FIG. 2C shows an example of a configuration of tone color setting data 60 that record various kinds of setting data and information to enable generation of musical tones using the selected tone color. Incidentally, the ROM 33 stores the tone color setting data with respect to each of the tone colors. The tone color setting data 60 are basically configured by four blocks 61–64. That is, tone color identification data 61 indicates a name of a tone color presently set by the tone color setting data 60. Waveform designation data designate waveform data corresponding to the tone color within the waveform data 41, 42, . . . stored in the tone color waveform data 40. Waveform setting information 63 set various parameter data such as LFO (i.e., Low Frequency Oscillator), filter and envelope with regard to the tone color. Pattern information 64 contains pattern data suited to the tone color. Incidentally, the pattern information is not necessarily stored with respect to all of tone colors of the tone color extension board 3. In other words, the pattern information is not stored with respect to certain tone colors which are not fitted to reproduction of sound patterns.

Figure 2D:
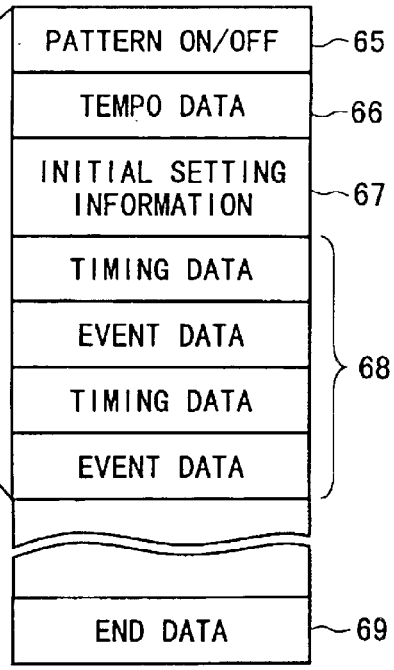
FIG. 2D shows a configuration of pattern information contained in the tone color setting data.

Details of the pattern information 64 are shown in FIG. 2D. The pattern information 64 is basically configured by five blocks 65–69. That is, pattern-on/off data 65 indicates a decision as to whether musical tones are reproduced using pattern data with respect to a default tone color, which is selected, or not. Tempo data 66 designates a reproduction tempo of the pattern data. Initial setting information 67 stores initial information for reproduction of the pattern data. A reference numeral 68 designates blocks corresponding to pairs of timing data and event data, which occupy important elements of the pattern data. Further, end data 69 indicates an end of the pattern information.

In FIG. 2D, "on" or "off" is set to the pattern-on/off data 65. Herein, the performer is capable of changing the setting (i.e., "on" or "off") of the pattern-on/off data 65 by operating a specific switch within the operators 15 of the main sound source device 1. The tempo data 66 controls the timer 35 of the tone color extension board 3 to set the prescribed reproduction tempo. The initial setting information 67 contains information (such as the aforementioned identifiers being set for different functions respectively, see FIG. 2B) indicating a function (or functions) which can be executed in response to the tone color presently set. In addition, the initial setting information 67 also contains information designating a register (or a range of pitches) used for generation of arpeggio sounds if the pattern information is related to generation of the arpeggio pattern. Or, the initial setting information 67 contains information indicating an assignment status of phrases being assigned to keys of a keyboard if the pattern information is related to multiple phrase data.

Incidentally, the timing data (see FIG. 2D) is duration data counting a number of clock pulses that are sequentially generated after a previous event. In addition, the event data corresponds to event information such a key-on event or a key-off event which is being processed at the timing designated by the corresponding timing data.

Figure 3:
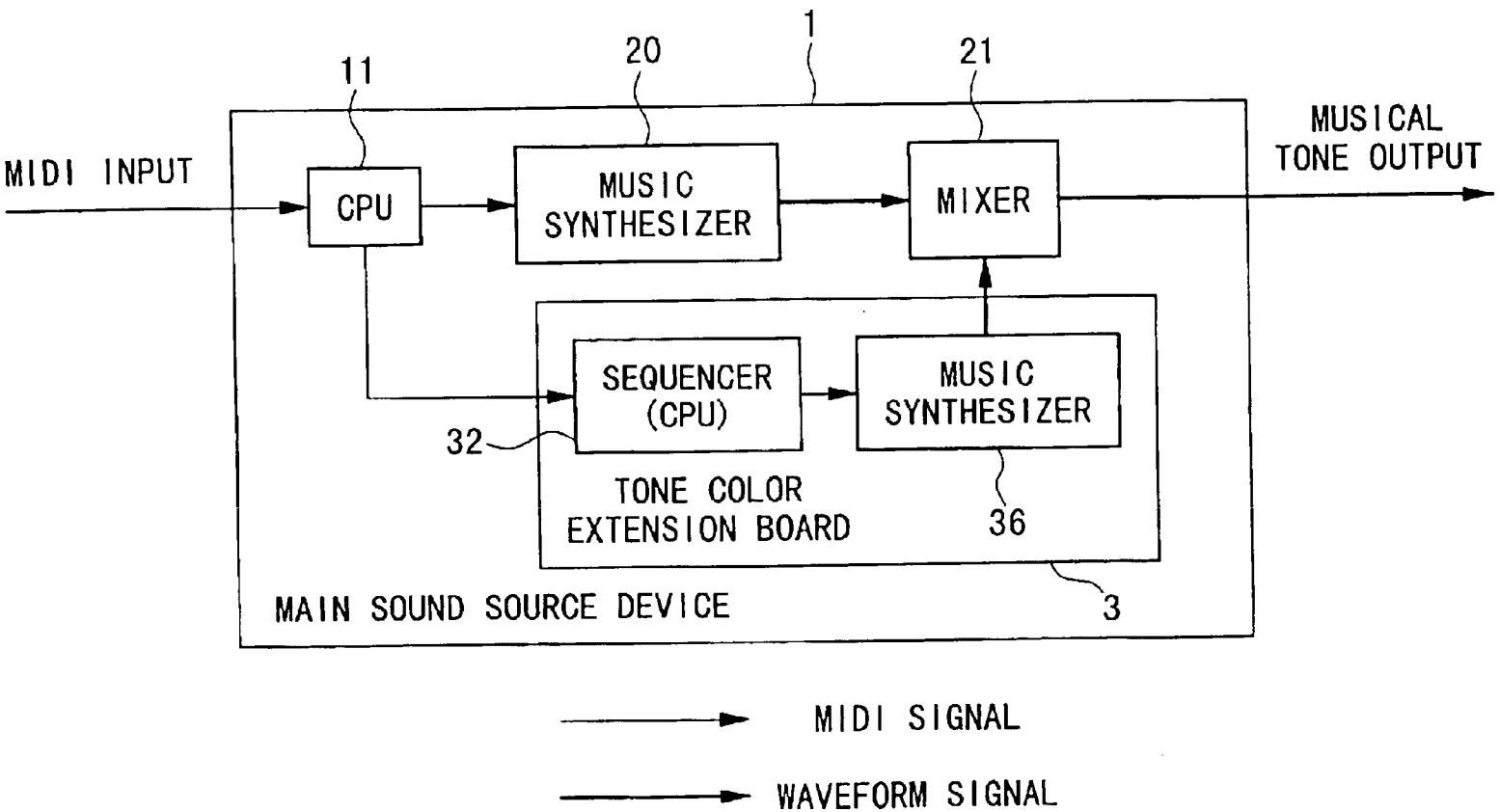
FIG. 3 is a simplified block diagram showing an outline of operations of the musical tone generation apparatus of FIG. 1.

FIG. 3 is a simplified block diagram showing an outline of operations of the main sound source device 1 installing the tone color extension board 3. That is, MIDI signals given from the external MIDI device 2 are input to the main sound source device 1. Under control of the CPU 11 of the main sound source device 1, key-operation signals regarding the extended tone colors installed on the tone color extension board 3 are directly transferred to the tone color extension board 3, while other key-operation signals are supplied to the music synthesizer 20 to produce corresponding musical tone signals, which are forwarded to the mixer 21. The CPU 32 of the tone color extension board 3 acts as a sequencer for generation of sound patterns as well. So, the CPU 32 produces sequence data based on selected key-operation signals, which are selected from among the key-operation signals being transferred from the main sound source device 1 and which are related to generation of sound patterns. The sequence data used for generation of sound patterns are forwarded to the music synthesizer 36 on the tone color extension board 3. Other key-operation signals which are not related to generation of sound patterns are directly supplied to the music synthesizer 36 without intervention of the sequencer. Thus, the music synthesizer 36 generates musical tone signals with respect to the extended tone colors. Those musical tone signals are supplied to the mixer 21, wherein they are mixed together with the musical tone signals produced by the music synthesizer 20 of the main sound source device 1. Thus, the mixer 21 produces mixed musical tone signals, to which prescribed effects are adequately imparted according to needs. Then, resultant musical tone signals are output to the external.

Next, concrete operations of the main sound source device 1 and the tone color extension board 3 will be described in detail with reference to FIGS. 4A, 4B and FIGS. 5A, 5B.

Figure 4A:
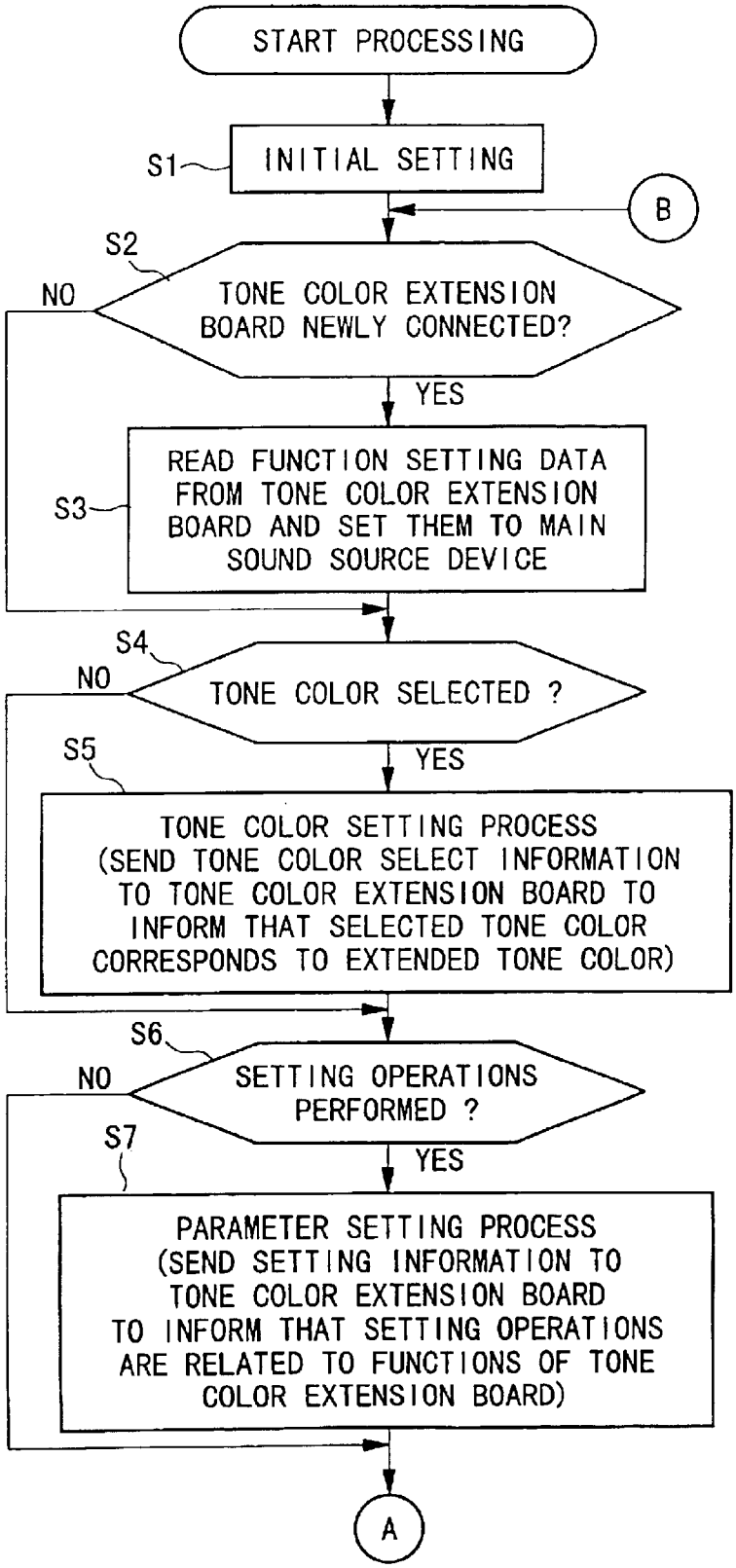
FIG. 4A is a flowchart showing a first part of processing being executed by a main sound source device shown in FIG. 1.
Figure 4B:
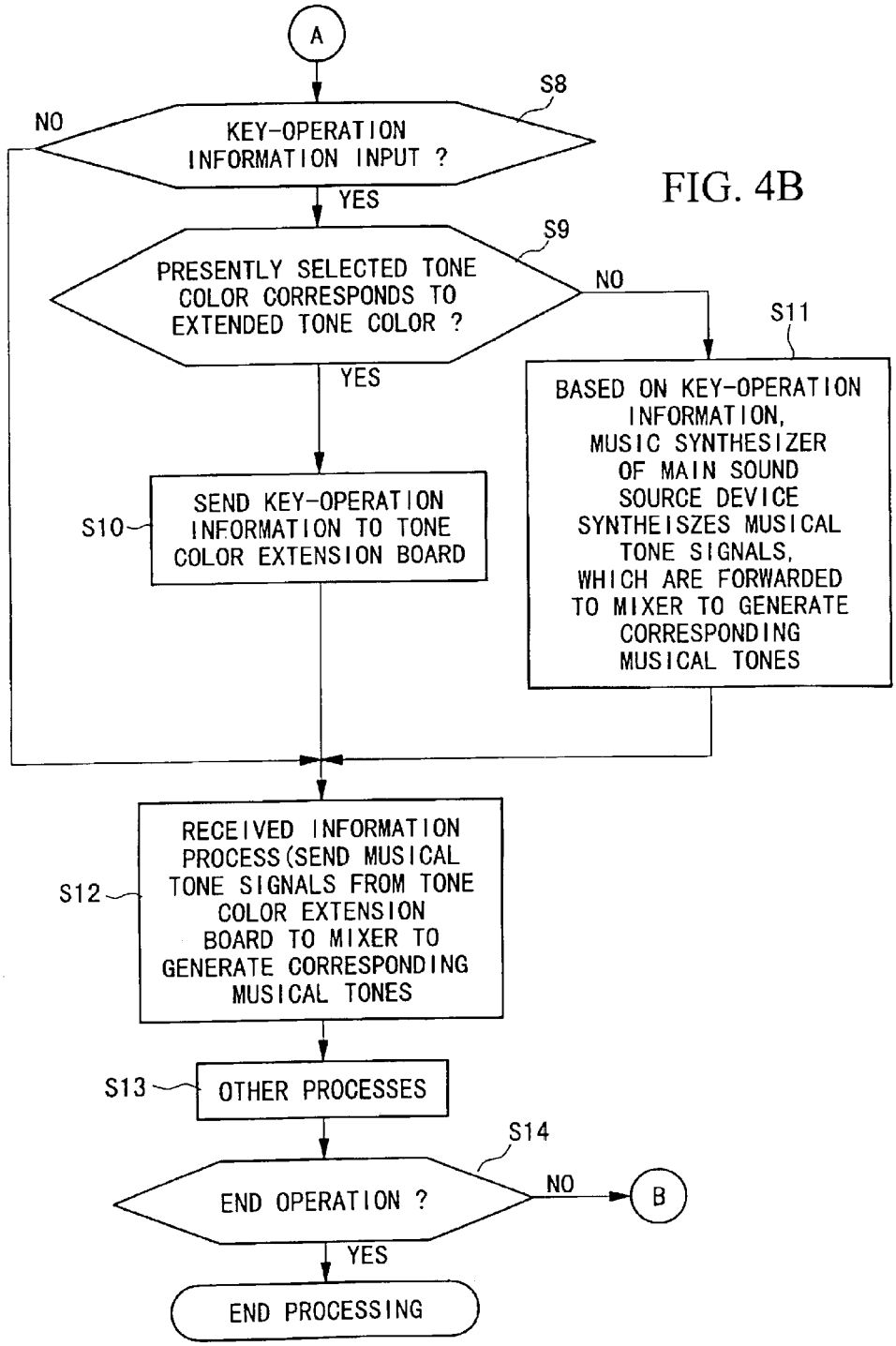
FIG. 4B is a flowchart showing a second part of processing being executed by the main sound source device.

FIGS. 4A and 4B show contents of processing of the main sound source device 1 shown in FIG. 1. When electric power is applied to the main sound source device 1 to start it processing, the main sound source device 1 (actually, the CPU 11) proceeds to step S1 regarding initial setting shown in FIG. 4A. In step S1, initial setting (or initialization) is effected on several circuits such as the RAM 13 in the main sound source device 1. In step S2, the device 1 makes a decision as to whether a tone color extension board is newly installed (or connected) or not. If a decision result is "N0", the device 1 skips step S3 to proceed to step S4. If the device 1 detects that the tone color extension board is newly installed and connected therewith, the device 1 proceeds to step S3. In step S3, the device 1 reads function setting data 50 (see FIG. 2B) from the tone color extension board 3 to transfer them to a prescribed area of the RAM 13. This allows extended tone colors provided from the tone color extension board 3 to be displayed on the screen of the display 17 together with content of a tone color list storing preset tone colors which are stored in the main sound source device 1 in advance. So, a user (or performer) is capable of selecting the extended tone colors by operating the tone color select switches of the operators 15. In addition, the step S3 also sets new functions provided by the tone color extension board 3 to the main sound source device 1, so that the user is capable of controlling them by operating prescribed switches of the operators 15. If the tone color extension board 3 does not install the new functions, the step S3 sets only the extended tone colors to the main sound source device 1.

In step S4, the device 1 makes a decision as to whether the user operates the operator(s) 15 to select a tone color or not. If a decision result is "YES", the device 1 proceeds to step S5, wherein it performs a tone color setting process. If the decision result is "NO", the device 1 skips the step S5 to proceed to step S6. In the tone color setting process of the step S5, the device 1 controls the music synthesizer 20 to enable generation of musical tones using the tone color selected by the operator(s) 15. If the selected tone color coincides with one of the extended tone colors installed on the tone color extension board 3, the device 1 sends tone color select information to the tone color extension board 3. That is, the device 1 informs the tone color extension board 3 that the extended tone color is selected by the operator(s) 15.

In step S6, the device 1 makes a decision as to whether setting operations are performed or not. Herein, the setting operations are performed to set parameters and functions with respect to the selected tone color. If no setting operation is made, the device 1 skips the step S7 to proceed to step S8 shown in FIG. 4B. Incidentally, the device 1 proceeds to step S8 under prescribed conditions where parameters are adequately set with respect to the preset tone color of the main sound source device 1 or the extended tone color of the tone color extension board 3, or setting operations are made with respect to the new functions of the tone color extension board 3. If the setting operations are made in connection with the extended tone color or new function of the tone color extension board 3, the device 1 transfers setting information to the tone color extension board 3. That is, the device 1 informs the tone color extension board 3 that the setting operations are made with regard to the tone color extension board 3.

In step S8, the device 1 makes a decision as to whether it receives key-operation information from the external MIDI device 2 or not. Then, the device 1 proceeds to step S9, wherein a decision is made as to whether the presently selected tone color coincides with one of the extended tone colors of the tone color extension board 3 or not. In other words, the device 1 makes a decision whether to generate musical tones using the extended tone color in response to the key-operation information. If the selected tone color coincides with the extended tone color, in other words, if the device 1 is set to enable generation of the musical tones using the extended tone color in response to the key-operation information, the device 1 transfers the key-operation information to the tone color extension board 3 in step S10. On the other hand, if the selected tone color coincides with the preset tone color of the main sound source device 1, in other words, if the device 1 is set to enable generation of the musical tones using the preset tone color in response to the key-operation information, the device 1 proceeds to step S11 from step S9. In step S11, the music synthesizer 20 synthesizes musical tone signals in response to the key-operation information, so that the musical tone signals are forwarded to the mixer 21, by which corresponding musical tones are being produced.

After completion of the step S10 or S11, the device 1 proceeds to step S12, wherein the device 1 receives musical tone signals from the tone color extension board 3 to send them to the mixer 21, by which corresponding musical tones are being produced.

In step S13, the device 1 performs other processes. For example, the device 1 automatically reproduces demosounds, or the device 1 displays a list of the functions installed on the tone color extension board 3 as well as present setting conditions or present setting status with regard to parameters and tone colors.

In step S14, the device 1 makes a decision as to whether the user performs an end operation or not. If the end operation is not made, the device 1 reverts control to step S2, so that a series of steps S2 to S13 are being repeated.

As described above, the musical tone generation apparatus of the present embodiment is basically designed such that the main sound source device 1 responds to installation of the tone color extension board 3 that stores the function setting data 50 in advance. So, the main sound source device 1 reads the function setting data 50 from the tone color extension board 3 to perform assignment of functions to the prescribed switches of the operators 15. For this reason, the main sound source device 1 is capable coping with installation of any types of tone color extension boards that install new tone colors and new functions. That is, the main sound source device 1 is capable of performing setting operations with respect to any kinds of new tone colors and new functions installed on the tone color extension boards by using the operators 15. As compared with other apparatuses and devices, the main sound source device 1 is capable of easily performing setting operations with respect to the new functions accompanied with the extended tone colors installed on the tone color extension board 3.

In addition, information regarding the extended tone colors and/or new functions is directly transferred to the tone color extension board 3. Further, musical tone signals generated by the tone color extension board 3 are supplied to the mixer 21 together with musical tone signals generated by the main sound source device 1, so that the mixer 21 imparts effects to the musical tone signals, which are then output to the external system or device. That is, processes regarding the extended tone colors and new functions are executed on the tone color extension board 3, so they do not increase loads in processing of the main sound source device 1.

Figure 5A:
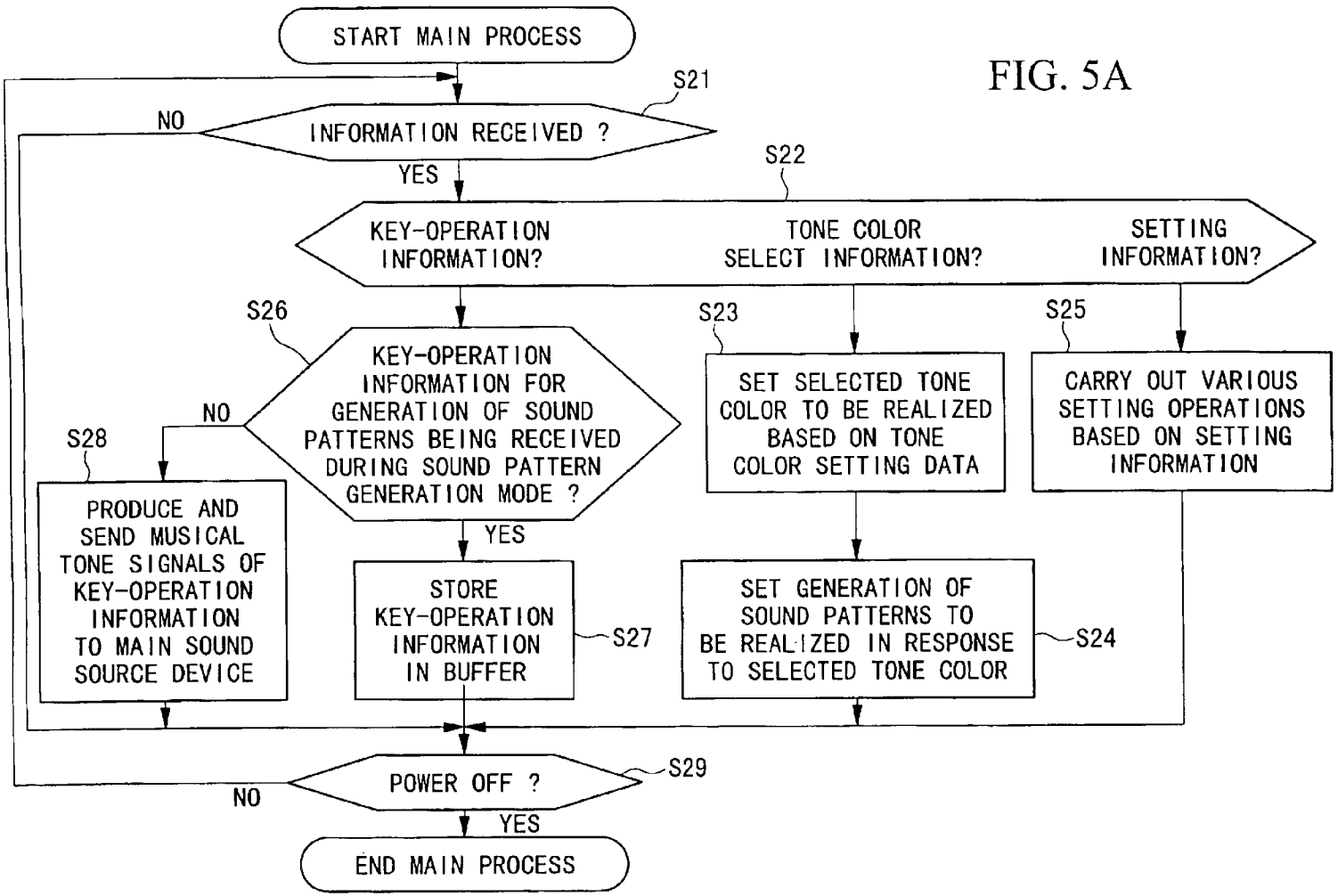
FIG. 5A is a flowchart showing a main process being executed on a tone color extension board shown in FIG. 1.

Next, processes of the tone color extension board 3 will be described in detail with reference to FIGS. 5A and 5B. FIG. 5A is a flowchart showing a main process being executed on the tone color extension board 3. This main process is repeatedly executed during a period of time between a first timing when a power switch (not shown) is turned ON so that electric power is applied to the main source device 1 and a second timing when the power switch is turned OFF.

When the main process is started, the tone color extension board 3 (actually, the CPU 32) proceeds to step S21 wherein a decision is made as to whether the board 3 receives information from the main sound source device 1 or not.

If a decision result is "NO", the CPU 32 of the board 3 directly transfers control to step S29 to make a decision as to whether the power switch is turned OFF or not. If the power switch is not turned OFF, the CPU 32 reverts control back to the step S21 again. Thus, the CPU 32 waits for signals or information being given from the main sound source device 1. When receiving some information from the main sound source device 1, the CPU 32 proceeds to step S22. In step S22, the CPU 32 discriminates content of the received information.

If the received information correspond to the tone color select information which selects the extended tone color and which the board 3 receives from the main sound source device 1 in the aforementioned step S5 (see FIG. 4A), the CPU 32 transfers control to step S23 from step S22. In step S23, the CPU 32 sets the presently selected tone color to be realized based on its tone color setting data. That is, the tone color setting data (see FIG. 2C) regarding the selected tone color are transferred from the ROM 33 to the prescribed area of the RAM 34, so that the CPU 32 sets the music synthesizer 36 to enable generation of musical tones using the selected tone color. In step S24, if the tone color setting data of the selected tone color contain pattern information in which pattern-on/off data 65 (see FIG. 2D) is "ON", the CPU 32 sets generation of sound patterns to be realized. That is, the CPU 32 reads out the pattern information to set an interrupt period corresponding to tempo data 66 to the timer 35 while transferring initial setting information 67 to a prescribed area of the RAM 34. After completion of the step S24, the CPU 32 transfers control to step S29.

If the received information correspond to setting information which the board 3 receives from the main sound source device 1 in the aforementioned step S7 shown in FIG. 4A, the CPU 32 transfers control to step S25 from step S22. In step S25, the CPU 32 performs various kinds of setting processes based on the setting information. For example, the CPU 32 sets parameters for the selected tone color and a tempo (i.e., interrupt period) as well as functions of the board 3. That is, the CPU 32 changes contents of the tone color setting information and pattern information, which are respectively stored in the prescribed areas of the RAM 34, in response to setting operations effected on the operators 15 of the main sound source device 1.

If the received information correspond to key-operation information which the board 3 receives from the main sound source device 1 in the aforementioned step S10 shown in FIG. 4B, the CPU 32 transfers control to step S26 from step S22. In step S26, the CPU 32 makes a decision as to whether the key-operation information used for generation of sound patterns is received during a sound pattern generation mode or not. In the sound pattern generation mode, the main sound source device 1 (or the tone color extension board 3) is set to enable generation of sound patterns. In the case of the arpeggio, for example, a decision is made as to whether keys being simultaneously depressed by a performer belong to a specific register, which is specifically used for generation of sounds of the arpeggio, or not. In the case of the phrase, a decision is made as to whether the received key-operation information is related to a specific key, to which the phrase is assigned in advance, or not.

If the received key-operation information is related to generation of sound patterns during the sound pattern generation mode, a decision result of the step S26 is "YES", so that the CPU 32 transfers control to step S27 to store the key-operation information in a buffer (not shown). Then, the CPU 32 transfers control to step S29. Incidentally, the key-operation information correspond to key-on data and/or key-off data. Herein, the key-on data are sequentially stored in the buffer in an order to sequentially input them. In addition, when receiving the key-off data, the CPU 32 deletes the corresponding key-on data in the buffer.

If the decision result of the step S26 is "NO", it is declared that the key-operation information is not related to generation of sound patterns. So, the CPU 32 transfers control to step S28, wherein the music synthesizer 36 synthesizes and generates musical tone signals based on the key-operation information, so that the musical tone signals are transferred to the main sound source device 1. The main sound source device 1 receives the musical tone signals from the tone color extension board 3 in the aforementioned step S12 shown in FIG. 4B. Then, the musical tone signals are forwarded to the mixer 21, by which corresponding musical tones are being produced.

Figure 5B:
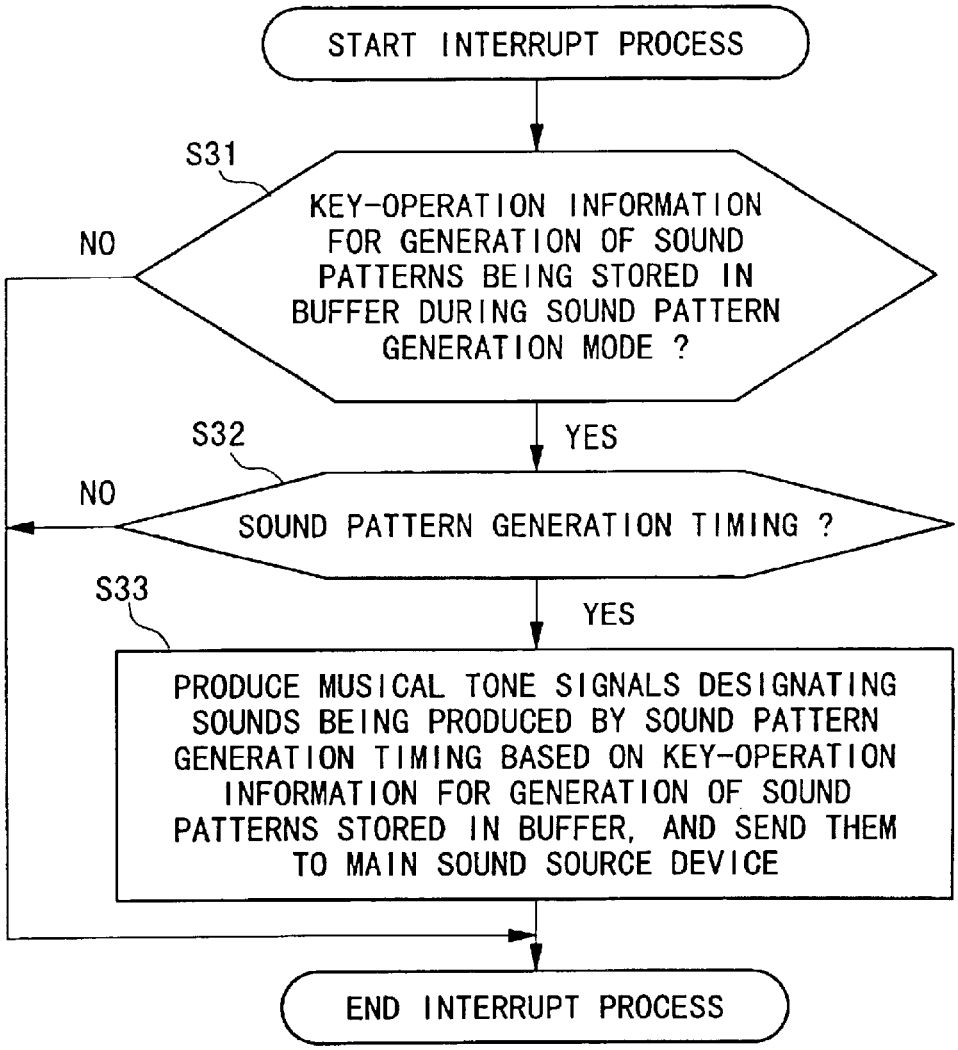
FIG. 5B is a flowchart showing an interrupt process being executed on the tone color extension board.

FIG. 5B is a flowchart showing an interrupt process, which is activated by the step S24 of the main process shown in FIG. 5A in which the tone color extension board 3 is set to enable generation of sound patterns. In addition, the interrupt process is started by every period which is determined by the tempo data 66 of the pattern information (see FIGS. 2C, 2D). Thus, it is possible to perform reproduction of sound patterns using the extended tone colors of the tone color extension board 3 by the interrupt process. That is, the main sound source device 1 is capable of executing a sequence process or an automatic performance process by using the timing data and event data 68 of the pattern information 64.

When the interrupt process is started, the CPU 32 proceeds to step S31 to make a decision as to whether the buffer stores key-operation information (see step S27) that is related to generation of sound patterns during a sound pattern generation mode or not. If a decision result is "NO", the CPU 32 immediately ends execution of the interrupt process. If the decision result of the step S31 is "YES", the CPU 32 proceeds to step S32 to make a decision as to whether the present timing coincides with a sound pattern generation timing, which is designated by the timing data (see FIG. 2D) of the pattern information, or not. Concretely speaking, the CPU 32 performs the following operations:

The CPU 32 measures a count value representative of a progression time by counting a number of clock pulses being sequentially generated by the timer 35. So, the CPU 32 compares the count value with a value of the timing data of the pattern information, by which it makes a decision as to whether the present timing coincides with the sound pattern generation timing or not.

If the CPU 32 determines in the step S32 that the present timing does not coincide with the sound pattern generation timing, the CPU 32 ends execution of the interrupt process.

If the CPU 32 determines that the present timing coincides with the sound pattern generation timing, the CPU 32 transfers control to step S33. In step S33, the CPU 32 controls the music synthesizer 36 to synthesize and generate a musical tone signal based on the key-operation information used for generation of sound patterns stored in the buffer, wherein the musical tone signal corresponds to a musical tone which should be generated at the present timing corresponding to the event data. The musical tone signal is transferred to the main sound source device 1.

In the case of the arpeggio realizing a sound pattern, for example, musical tone signals are sequentially generated based on multiple key-on data, which are produced by simultaneous depression of multiple keys and which are transferred from the main sound source device 1 and stored in the buffer. In step S33, the music synthesizer 36 generates a musical tone signal corresponding to a musical tone, which should be generated at the present timing, within the aforementioned musical tone signals. In the case of the phrase realizing a sound pattern, melody sounds are sequentially generated based on phrase data corresponding to key-on data used for generation of the sound pattern, which are transferred from the main sound source device 1. In step S33, the music synthesizer 36 generates a musical tone signal corresponding to a musical tone, which should be generated at the present timing, within the aforementioned musical tone signals.

Then, the musical tone signal is received by the main sound source device 1 in step S12, wherein the mixer 21 inputs the musical tone signal to thereby produce its corresponding musical tone by the sound system 23.

As described above, it is possible to execute the sequence process defined by the pattern information 64 by repeatedly executing the interrupt process.

In the above, the main sound source device 1 and the tone color extension board 3 are designed to allow generation of the sound pattern corresponding to either the arpeggio or phrase with respect to a single (extended) tone color. In other words, they are designed to allow execution of only one additional function corresponding to either the arpeggio or phrase with respect to a single tone color. Of course, it is possible to modify the present embodiment to selectively operate multiple additional functions with respect to a single tone color. For example, the present embodiment is modified to switch over the sound pattern generation mode between the arpeggio and phrase.

The present embodiment is described such that a sound pattern generation function is added as a new function by installing the tone color extension board 3 in the main sound source device 1. Of course, the new function being added by the extension board is not necessarily limited to the sound pattern generation function. In other words, it is possible to add any types of functions that are needed for the extension board interconnected with the main sound source device.

In addition, the present embodiment is described such that the tone color extension board is used as an example of the extension board being installed in the main sound source device. Of course, the extension board is not necessarily limited to the tone color extension board. So, it is possible to use any types of extension boards that install new functions in the main sound source device. For example, it is possible to use an extended effect board, an extended communication board and an extended automatic performance board.

Figure 6:
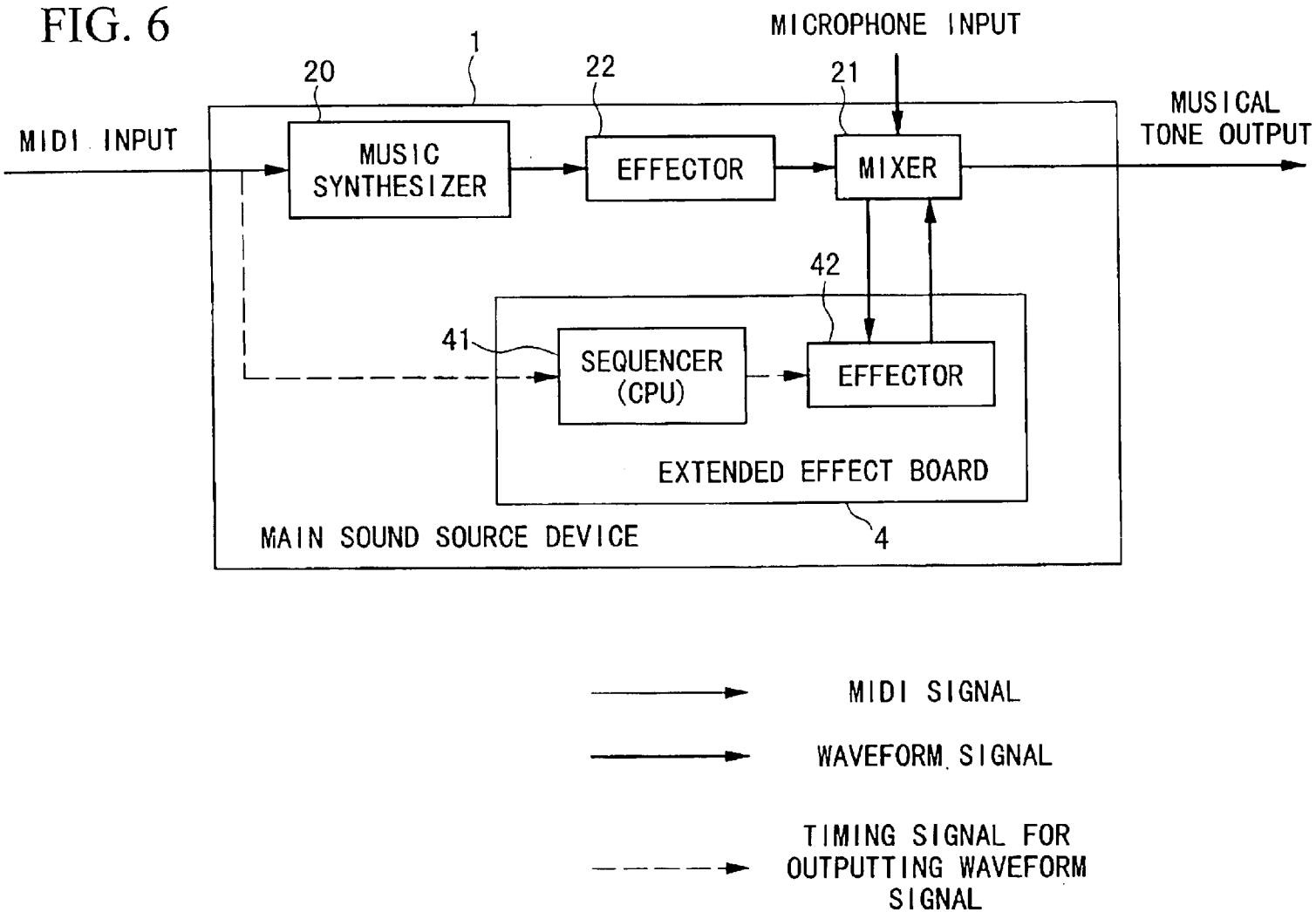
FIG. 6 is a simplified block diagram showing an outline of operations of the musical tone generation apparatus that installs an extended effect board instead of the tone color extension board.

FIG. 6 is a simplified block diagram showing an outline of operations of the musical tone generation apparatus installing an extended effect board, wherein parts equivalent to those shown in FIGS. 1 and 3 are designated by the same reference numerals, hence, the description thereof will be omitted. As similar to the musical tone generation apparatus of FIGS. 1 and 3, the musical tone generation apparatus of FIG. 6 uses a main sound source device 1, a music synthesizer 20, a mixer 21 and an effector 22. Herein, the main sound source device 1 shown in FIG. 1 is equipped with an external waveform input terminal (not shown) for inputting external waveform signals from a microphone or an external audio device, for example. In addition, the main sound source device 1 is also equipped with an A/D converter (not shown) for performing analog-to-digital conversion on the external waveform signals to produce signals, which are forwarded to the mixer 21. The main sound source device 1 installs an extended effector board 4 containing a CPU 41, which acts as a sequencer as well, and an effector 42 which is capable of imparting extended effects to musical tone signals. Herein, the extended effects differ from effects which are provided by the effector 22 of the main sound source device 1. For example, the extended effect board 4 is designed such that the effector 42 corresponds to an extended effector which additionally produces harmony sounds in connection with sounds input by the microphone. So, the CPU 41 has a sequencer function by which the harmony sounds are produced basically together with the sounds of the microphone but they are produced being slightly shifted in timings as compared with generation timings of the sounds of the microphone.

Now, the external MIDI device 2 (not shown in FIG. 6) supplies MIDI signals to the main sound source device 1, wherein the music synthesizer 20 generates corresponding musical tone signals. The effector 22 built in the main sound source device 1 imparts prescribed effects to the musical tone signals to produce effect-imparted musical tone signals, which are forwarded to the mixer 21. In addition, the main sound source device 1 is also supplied with external waveform signals given from the microphone by way of the external waveform input terminal (not shown), wherein the external waveform signals are subjected to analog-to-digital conversion to produce microphone signals, which are supplied to the effector 42 of the extended effect board 4 by way of the mixer 21. The effector 42 produces harmony sound signals representative of harmony sounds in response to the microphone signals. Herein, the CPU 41 controls the effector 42 such that the harmony sound signals are shifted from the microphone signals with respect to timings for actually producing sounds. In other words, the effector 42 outputs the harmony sound signals to the mixer 21, wherein output timings are controlled by pattern data reproduced by the sequencer 41 such that the harmony sounds are produced at timings which are slightly different from timings for producing microphone sounds. Incidentally, reproduction of the pattern data by the sequencer 41 can be controlled by the MIDI signals, which is shown by a dotted line in FIG. 6.

As described above, the effector 22 of the main sound source device 1 outputs the effect-imparted signals corresponding to the MIDI signals, while the effector 42 of the extended effect board 4 outputs extended-effect-imparted signals (e.g., harmony signals corresponding to the microphone signals). The mixer 21 mixes the effect-imparted signals of the effector 22 together with the extended-effect-imparted signals of the effector 42. Thus, the mixer 21 produces mixed signals, which are forwarded to the sound system (not shown) to produce corresponding musical tones and/or other sounds.

Incidentally, the effector 42 of the extended effect board 4 is not necessarily designed to deal with the external waveform signals being input by the external waveform input terminal. In other words, the effector 42 is capable of dealing with musical tone signals, which are synthesized and generated by the music synthesizer 20 of the main sound source device 1. In that case, the effector 42 imparts the extended effects to the musical tone signals.

In addition, the extended effect of the effector 42 is not necessarily related to additional production of the harmony sounds in response to the microphone sounds. In other words, the effector 42 is capable of imparting other types of extended effects such as reverb, chorus and echo. In that case, for example, the sequencer 41 of the extended effect board 4 receives the MIDI signals (or MIDI information) input by the main sound source device 1. Then, the sequencer 41 reproduces pattern data (or pattern information) representative of a sound pattern corresponding to an arpeggio or a phrase on the basis of the MIDI information. The pattern information is supplied to the music synthesizer 20 to produce music information, which is then supplied to the extended effect board 4. So, the effector 42 imparts an extended effect to the music information to produce extended-effect imparted music information, which is then supplied to the mixer 21.

Further, the extended board being installed in the main sound source device is not necessarily limited to the aforementioned extended effect board 4. That is, the extended board can be optimally designed according to needs. For example, the extended board is redesigned to install the foregoing extended tone colors in addition to the extended effects and extended sequencer functions.

Lastly, the present embodiment describes the musical tone generation apparatus basically in a form of a hardware system installing an extension board. Of course, this invention is not necessarily limited to such hardware structure but is actualized by software processing. For example, substantially all parts of the musical tone generation apparatus can be actualized on a personal computer or the like in which they are displayed on a screen so that the user operates them with clicks of a mouse or the like. In that case, programs actualizing the parts of the musical tone generation apparatus are provided by storage medium such as floppy disks, compact disks and the like, or they are provided and downloaded from some computer networks such as Internet.

As described heretofore, this invention has a variety of technical features and effects, which are summarized as follows:

(1) The musical tone generation apparatus of this invention is basically configured by a main sound source device installing an extended board. Herein, the main sound source device contains a CPU, memories, a music synthesizer, a mixer, an effector and a sound system, while the extended board contains a CPU (or sequencer), memories and a music synthesizer (or an effector). So, the extended board is capable of easily actualizing new functions such as extended tone colors, extended effects and sequencer functions, which are optimally designed.

(2) Because the CPU of the extended board has a capability of sharing loads of processing with the CPU of the main sound source device, the new functions do not increase load of processing of the CPU of the main sound source device. So, it is possible to avoid occurrence of unwanted delay in generation of musical tones and other sounds.

(3) The main sound source device is capable of setting and controlling the new functions being newly introduced by the extended board. This improves performability in playing music or sound reproduction.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical tone generation apparatus incorporating a music synthesizer and an operator, comprising:

a readout for reading first function setting information from an extension board, wherein the extension board comprises a first storage device for storing pattern information representing a prescribed sound pattern, a second storage device for storing the first function setting information, a decision device for deciding whether or not received performance information is to be used for generating the prescribed sound pattern and a reproducing device for reproducing musical tone signals of the prescribed sound pattern having an extended music element in accordance with the pattern information based on the received performance information when the decision device determines that the received performance information is to be used for generating the prescribed sound pattern and for reproducing musical tone signals having the extended music element based on the received performance information without using the pattern information when the decision device determines that the received performance information is not to be used for generating the prescribed sound pattern.

a setting device for making a setting regarding the reproduction of the musical tone signals of the prescribed sound pattern based on the first function setting information in response to a manual operation applied to the operator, and a sending device for sending second function setting information regarding the setting to the extension board.

2. A musical tone generation apparatus according to claim 1, wherein the extended music element is a tone color.

3. A musical tone generation apparatus according to claim 1, wherein the prescribed sound pattern is an arpeggio pattern.

4. A musical tone generation apparatus according to claim 1 further comprising an I/O interface for interconnection with the extension board, so that the readout device reads the first function setting information from the extension board by way of the I/O interface, and the sending device sends the second function setting information to the extension board by way of the I/O interface.

5. A musical tone generation apparatus according to claim 1, wherein the operator is operated in a process for setting the extended music element.

6. A musical tone generation apparatus according to claim 2 wherein the extension board provides a plurality of expanded tone colors, each of which is selectively used for reproduction of musical tone signals of the prescribed sound pattern.

7. A musical tone generation apparatus according to claim 3 wherein the extension board provides a plurality of expanded tone colors, each of which is selectively used for reproduction of musical tone signals of the arpeggio pattern.

8. A musical tone generation apparatus according to claim 1 wherein the readout device automatically reads the first function setting information from the extension board in a power-on event.

9. An extension board installed in a tone generator for generating musical tone signals in response to performance information, comprising:

a storage device for storing pattern information representing a prescribed sound pattern;

a decision device for deciding whether or not the performance information from the tone generator is to be used for generating the prescribed sound pattern; and a reproducing device for reproducing musical tone signals of the prescribed sound pattern in accordance with the pattern information based on the received performance information when the decision device determines that the received performance information is to be used for generating the prescribed sound pattern, and for reproducing musical tone signals based on the received performance information without using the pattern information when the decision devices determines that the received performance information is not to be used for generating the prescribed sound pattern, wherein the reproduced musical tone signals having an extended music element, and wherein the tone generator is independently incapable of generating musical tone signals having the extended music element.

10. An extension board according to claim 9, wherein the extended music element is a tone color and the reproduced musical tone signals have a specific tone color, which differs from an original tone color pre-installed in the tone generator.

11. An extension board according to claim 9, wherein the prescribed sound pattern is an arpeggio pattern.

12. An extension board according to claim 10, wherein the reproducing device secures a plurality of extended tone colors, each of which is selectively used for reproduction of musical tone signals of the sound pattern.

13. An extension board according to claim 11, wherein the reproducing device secures a plurality of extended tone colors, each of which is selectively used for reproduction of musical tone signals of the arpeggio pattern.

14. An extension board according to claim 9, wherein the extended music element is an effect, so that the reproducing device sequentially reproduces musical tone signals having the extended effect at timings being shifted from their original timings.

15. A musical tone generation system comprising:

a musical tone generation device incorporating a first music synthesizer that synthesizes first musical tones with a prescribed tone color in response to key-operation information; and a tone color extension board installed in the musical tone generation device to provide expansion of the prescribed tone color, wherein said tone color extension board comprises a sequencer for reproducing sound patterns in response to key-operation information that is supplied thereto from the musical tone generation device, and a second music synthesizer that synthesizes second musical tones with expanded tone colors in accordance with the sound patterns respectively, so that the musical tone generation device produces mixture of the first musical tones and the second musical tones.

16. A musical tone generation system according to claim 15 wherein the tone color extension board provides a plurality of the expanded tone colors, which differ from original tone colors pre-installed in the musical tone generation device and each of which is selectively used for reproduction of the sound patterns respectively.

17. A musical tone generation system according to claim 15 further comprising an effector for imparting effects to the mixture of the first and second musical tones.

18. A musical tone generation system comprising:

a musical tone generation device incorporating a first music synthesizer that synthesizes first musical tones with a prescribed tone color in response to key-operation information; and a tone color extension board installed in the musical tone generation device to provide expansion of the prescribed tone color, wherein said tone color extension board comprises a sequencer for reproducing arpeggio patterns in response to key-operation information that is supplied thereto from the musical tone generation device, and a second music synthesizer for sequentially generating second musical tones with expanded tone colors in accordance with the arpeggio patterns respectively, so that the musical tone generation device produces mixture of the first musical tones and the second musical tones.

19. A musical tone generation system according to claim 18 wherein the tone color extension board provides a plurality of the expanded tone colors, which differ from original tone colors pre-installed in the musical tone generation device and each of which is selectively used for reproduction of the arpeggio patterns respectively.

20. A musical tone generation system according to claim 18 further comprising an effector for imparting effects to the mixture of the first and second musical tones.

21. A musical tone generation method comprising the steps of:

reading first function setting information from an extension board, wherein the extension board comprises a first storage device for storing pattern information representing a prescribed sound pattern, a second storage device for storing the first function setting information, a decision device for deciding whether or not received performance information is to be used for generating the prescribed sound pattern and a reproducing device for reproducing musical tone signals of the prescribed sound pattern having an extended musical element in accordance with the pattern information based on the received performance information when the decision device determines that the received performance information is to be used for generating the prescribed sound pattern and for reproducing musical tone signals having the extended music element based on the received performance information without using the pattern information when the decision device determines that the received performance information is not to be used for generating the prescribed sound pattern;

making a setting regarding the reproduction of the musical tone signals of the prescribed sound pattern based on the first function setting information in response to a manual operation applied to an operator; and sending second function setting information regarding the setting to the extension board.

22. A function expanding method performed by an extension board comprising the steps of:

storing pattern information representing a prescribed sound pattern in the extension board;

supplying performance information for generating musical tone signals from a tone generator to the extension board;

deciding whether or not the performance information from the tone generator is to be used for generating the prescribed sound pattern; and reproducing musical tone signals of the prescribed sound pattern in accordance with the pattern information based on the received performance information when the received performance information is to be used for generating the prescribed sound pattern and reproducing musical tone signals based on the received performance information without using the pattern information when the received performance information is not to be used for generating the prescribed sound pattern, wherein the reproduced musical tone signals having an extended music element, and wherein the tone generator is independently incapable of generating musical tone signals having the extended music element.

23. A musical tone generation method applicable to a musical tone generation device installing a tone color extension board to provide expansion of a prescribed tone color, said musical tone generation method comprising the steps of:

activating a first music synthesizer of the musical tone generation device to synthesize first musical tones with the prescribed tone color in response to key-operation information;

reproducing sound patterns in response to key-operation information that is supplied thereto from the musical tone generation device;

activating a second music synthesizer of the tone color extension board to synthesize second musical tones with expanded tone colors in accordance with the sound patterns respectively; and mixing the first musical tones together with the second musical tones to produce mixed musical tones.

24. A musical tone generation method applicable to a musical tone generation device installing a tone color extension board to provide expansion of a prescribed tone color, said musical tone generation method comprising the steps of:

activating a first music synthesizer of the musical tone generation device to synthesize first musical tones with the prescribed tone color in response to key-operation information;

reproducing arpeggio patterns in response to key-operation information on the tone color extension board;

activating a second music synthesizer of the tone color extension board to sequentially generate second musical tones with expanded tone colors in accordance with the arpeggio patterns respectively; and mixing the first musical tones together with the second musical tones to produce mixed musical tones.

25. A machine-readable media storing programs and data that cause a musical tone generation device installing an extension board to perform a musical tone generation method comprising the steps of:

reading first function setting information from an extension board, wherein the extension board comprises a first storage device for storing pattern information representing a prescribed sound pattern, a second storage device for storing the first function setting information, a decision device for deciding whether or not received performance information is to be used for generating the prescribed sound pattern and a reproducing device for reproducing musical tone signals of the prescribed sound pattern having an extended musical element in accordance with the pattern information based on the received performance information when the decision device determines that the received performance information is to be used for generating the prescribed sound pattern and for reproducing musical tone signals having the extended music element based on the received performance information without using the pattern information when the decision device determines that the received performance information is not to be used for generating the prescribed sound pattern;

making a setting regarding the reproduction of the musical tone signals of the prescribed sound pattern based on the first function setting information in response to a manual operation applied to an operator; and sending second function setting information regarding the setting to the extension board.

26. A machine-readable media storing programs and data that cause an extension board installed in a tone generator to perform a function expanding method comprising the steps of:

storing pattern information representing a prescribed sound pattern in an extension board;

supplying performance information for generating musical tone signals from the tone generator to the extension board;

deciding whether or not the performance information from the tone generator is to be used for generating the prescribed sound pattern; and reproducing musical tone signals of the prescribed sound pattern in accordance with the pattern information based on the received performance information when the received performance information is to be used for generating the prescribed sound pattern and reproducing musical tone signals based on the received performance information without using the pattern information when the received performance information is not to be used for generating the prescribed sound pattern, wherein the reproduced musical tone signals having an extended music element, and wherein the tone generator is independently incapable of generating musical tone signals having the extended music element.

27. A machine-readable media storing programs and data that cause a musical tone generation device installing a tone color extension board to perform a musical tone generation method comprising the steps of:

activating a first music synthesizer of the musical tone generation device to synthesize first musical tones with a prescribed tone color in response to key-operation information;

reproducing sound patterns in response to key-operation information that is supplied thereto from the musical tone generation device;

activating a second music synthesizer of the tone color extension board to synthesize second musical tones with expanded tone colors in accordance with the sound pattern respectively; and mixing the first musical tones together with the second musical tones to produce mixed musical tones.

28. A machine-readable media storing programs and data that cause a musical tone generation device installing a tone color extension board to perform a musical tone generation method comprising the steps of:

activating a first music synthesizer of the musical tone generation device to synthesize first musical tones with a prescribed tone color in response to key-operation information;

reproducing arpeggio patterns in response to key-operation information on the tone color extension board;

activating a second music synthesizer of the tone color extension board to sequentially generate second musical tones with expanded tone colors in accordance with the arpeggio patterns respectively; and mixing the first musical tones together with the second musical tones to produce mixed musical tones.

* * * * *